US011982157B2

(12) United States Patent
Li et al.

(10) Patent No.: US 11,982,157 B2
(45) Date of Patent: May 14, 2024

(54) DIAPHRAGM WALL DOWN-THE-HOLE HAMMER TRENCHING MACHINE AND USE METHOD THEREOF

(71) Applicant: Xinxing Li, Hubei (CN)

(72) Inventors: Sheng Li, Hubei (CN); Xinxing Li, Hubei (CN)

(73) Assignee: Xinxing Li, Wuhan (CN)

( * ) Notice: Subject to any disclaimer, the term of this patent is extended or adjusted under 35 U.S.C. 154(b) by 0 days.

(21) Appl. No.: 18/024,773

(22) PCT Filed: Aug. 23, 2021

(86) PCT No.: PCT/CN2021/114006

§ 371 (c)(1),
(2) Date: Mar. 5, 2023

(87) PCT Pub. No.: WO2022/052796

PCT Pub. Date: Mar. 17, 2022

(65) Prior Publication Data

US 2023/0323735 A1 Oct. 12, 2023

(30) Foreign Application Priority Data

Sep. 8, 2020 (CN) ..... 202010934370.8

(51) Int. Cl.
*E21B 4/06* (2006.01)
*E21B 4/14* (2006.01)
(Continued)

(52) U.S. Cl.
CPC ..... *E21B 4/145* (2013.01); *E21B 7/001* (2013.01)

(58) Field of Classification Search
CPC ... E21B 4/16; E21B 4/14; E21B 10/36; E21B 10/38; E21B 10/40; E21B 4/06;
(Continued)

(56) References Cited

U.S. PATENT DOCUMENTS 3,148,741 A * 9/1964 Holsing ..... E21B 10/36 175/413
3,870,113 A * 3/1975 Slawson ..... E21B 4/16 175/96

(Continued)

FOREIGN PATENT DOCUMENTS

CN 108104713 A 6/2018
CN 110886579 A 3/2020
CN 210659913 U 6/2020

OTHER PUBLICATIONS

International Search Report of PCT Patent Application No. PCT/CN2021/114006 issued on Nov. 18, 2021.

*Primary Examiner* — Kipp C Wallace

(57) ABSTRACT

A diaphragm wall down-the-hole hammer trenching machine comprises a crane, a guide frame, a push-pull device, cluster down-the-hole hammers, gas collecting hoods, a high-pressure medium pipe or cable, and a slurry discharge pipe. The crane suspends the guide frame; the cluster down-the-hole hammers are connected to the bottom of the guide frame by means of the push-pull device; each cluster down-the-hole hammer comprises a primary hammer and secondary hammers; the plurality of secondary hammers are provided on each primary hammer; one gas collecting hood is provided on the lower part of each primary hammer; the high-pressure medium pipe or cable passes through the guide frame and the push-pull device to enter a primary hammer distribution pipeline to drive the secondary hammers to perform percussive drilling; mud channels are provided in each primary hammer; and the slurry discharge pipe passes through the guide frame and communicates with the gas collecting hoods.

15 Claims, 3 Drawing Sheets

(51) Int. Cl.
*E21B 7/00* (2006.01)
*E21B 10/38* (2006.01)

(58) Field of Classification Search
CPC ..... E21B 1/00; E21B 1/12; E21B 1/24; E21B 1/30; E21B 1/32; E21B 1/26; E21B 1/28
See application file for complete search history.

(56) References Cited

U.S. PATENT DOCUMENTS

| | | | | | |
|---|---|---|---|---|---|
| 5,174,390 | A * | 12/1992 | Kurt | E21B 7/28 | 175/96 |
| 2010/0018774 | A1* | 1/2010 | Furuki | E21B 4/14 | 175/418 |
| 2013/0118769 | A1* | 5/2013 | Lee | E21B 10/36 | 173/218 |
| 2013/0206481 | A1* | 8/2013 | Chan | E21B 4/14 | 175/296 |
| 2013/0306379 | A1* | 11/2013 | Chan | E21B 10/36 | 175/103 |
| 2014/0345895 | A1* | 11/2014 | Lee | E21B 4/14 | 173/1 |

* cited by examiner

DIAPHRAGM WALL DOWN-THE-HOLE HAMMER TRENCHING MACHINE AND USE METHOD THEREOF

FIELD

The present disclosure relates to the technical field of piling machinery, and more particularly relates to a diaphragm wall down-the-hole hammer trenching machine. The present disclosure also discloses a use method of the diaphragm wall down-the-hole hammer trenching machine.

BACKGROUND

An existing diaphragm wall entering-rock trenching machine is mainly a hydraulically driven trench milling machine, which is bulky and complex in equipment, difficult to manufacture, high in manufacturing cost, fast in equipment wear during construction, high in maintenance cost, low in rock drilling efficiency and high in energy consumption, and cannot be used for hard rock construction, and a maximum construction wall thickness is limited.

Therefore, there is an urgent need to develop a diaphragm wall down-the-hole hammer trenching machine with simple equipment, low manufacturing cost, low energy consumption during use, high hard rock drilling efficiency, wear-resistant drilling tools, easy maintenance, low cost, easy construction, and larger wall thickness.

SUMMARY

A first object of the present disclosure is to provide a diaphragm wall down-the-hole hammer trenching machine with simple equipment, low manufacturing cost, low energy consumption during use, high hard rock drilling efficiency, wear-resistant drilling tools, easy maintenance, low cost, easy construction, and larger wall thickness; and the disadvantages of high manufacturing cost, complex maintenance, high cost, low hard rock drilling efficiency, and small wall thickness caused by adopting a trench milling machine in the prior art are overcome.

A second object of the present disclosure is to provide a use method of the diaphragm wall down-the-hole hammer trenching machine. The construction efficiency is high.

In order to achieve the above first object of the present disclosure, the technical solution of the present disclosure is as follows: provided is a diaphragm wall down-the-hole hammer trenching machine, including a crane, a guide frame, a push-pull device, cluster down-the-hole hammers, gas collecting hoods, a high-pressure medium pipe or cable, and a slurry discharge pipe; wherein the crane suspends the guide frame;

the cluster down-the-hole hammers are connected to the bottom of the guide frame by means of the push-pull device;

the cluster down-the-hole hammers are rectangular, and are in a separate arrangement; each cluster down-the-hole hammer includes a primary hammer and secondary hammers; and the plurality of the secondary hammers are disposed on each primary hammer, the secondary hammers being down-the-hole hammers driven by a high-pressure medium or electrically;

the lower part of each primary hammer is provided with one gas collecting hood;

the high-pressure medium pipe or cable passes through the guide frame and the push-pull device to enter a primary hammer distribution pipeline to drive the secondary hammers to perform percussive drilling;

mud channels are formed in each primary hammer; and the slurry discharge pipe passes through the guide frame and communicates with the gas collecting hoods.

In the above technical solution, an exhaust port is formed in the middle-upper parts of the secondary hammers;

the exhaust port is higher than a lower opening of each gas collecting hood.

In the above technical solution, the secondary hammers include first secondary hammers and second secondary hammers; and the first secondary hammers are located on the outer sides and adjacent sides of the primary hammers; and the first secondary hammers are rectangular and close to each other.

In the above technical solution, each gas collecting hood is of a skirt-like structure.

In the above technical solution, the cluster down-the-hole hammers are movably connected with the guide frame by means of the push-pull device.

In order to achieve the above second object of the present disclosure, the technical solution of the present disclosure is as follows: provided is a use method of the diaphragm wall down-the-hole hammer trenching machine, including the steps of, Step 1: installation;

connecting a crane with a guide frame;

connecting cluster down-the-hole hammers to the bottom of the guide frame by means of a push-pull device;

allowing a high-pressure medium pipe or cable to pass through the guide frame and the push-pull device to enter a primary hammer distribution pipeline; and allowing a slurry discharge pipe to pass through the guide frame and communicate with gas collecting hoods;

Step 2: hoisting;

suspending, by the crane, the guide frame to a working point; and

Step 3: diaphragm wall down-the-hole hammer trenching driving secondary hammers to perform percussive drilling after the high-pressure medium pipe or cable enters the primary hammer distribution pipeline;

pushing and pulling primary hammers by the push-pull device so that the primary hammers are constantly and symmetrically separated or close to each other to achieve full-section rock drilling with the down-the-hole hammers; and mixing waste gas from the down-the-hole hammers with mud in the gas collecting hoods, discharging the mixture into the slurry discharge pipe through mud channels in the middles of the primary hammers under the action of mud pressure to form air-lift reverse circulation for slag removal, and discharging the mixture upwardly into a ground mud treatment system through the slurry discharge pipe; wherein during anhydrous dry hole construction, exhaust slag blowing or air reverse circulation slag removal is conducted at the bottoms of the secondary hammers.

In the above technical solution, a plurality of the secondary hammers are provided; and percussive drilling is randomly performed by the plurality of the secondary hammers.

The present disclosure has the following advantages:

(1) the diaphragm wall down-the-hole hammer trenching machine is simple in equipment, the matched crane and air compressor are both universal equipment, and no special design and manufacture is required, and thus, the manufacturing cost is much lower than that of a trench milling machine, and the diaphragm wall down-the-hole hammer trenching machine has wear-resistant drilling tools, easy maintenance, low cost, high hard rock construction efficiency, and low energy consumption;

(2) the diaphragm wall down-the-hole hammer trenching machine has easy construction, and larger trench width than a diaphragm wall trench milling machine, thereby improving the safety of a diaphragm wall engineering structure, saving a large amount of steel bar materials, and greatly reducing the engineering cost; and (3) the matched crane and air compressor of the present disclosure are both universal equipment, which can be used in other engineering fields, improving the equipment utilization rate.

The diaphragm wall down-the-hole hammer trenching machine is simple in equipment, the matched crane and air compressor are both universal equipment, and no special manufacturing is required, and thus, the manufacturing cost is much lower than that of a diaphragm wall trench milling machine, and the diaphragm wall down-the-hole hammer trenching machine has high hard rock construction efficiency, wear-resistant drilling tools, easy maintenance, low cost, low energy consumption during construction, and large trench width than the trench milling machine, thereby improving the safety of a diaphragm wall engineering structure, saving a large amount of steel bar materials, and achieving a high equipment utilization rate.

Figure 1:
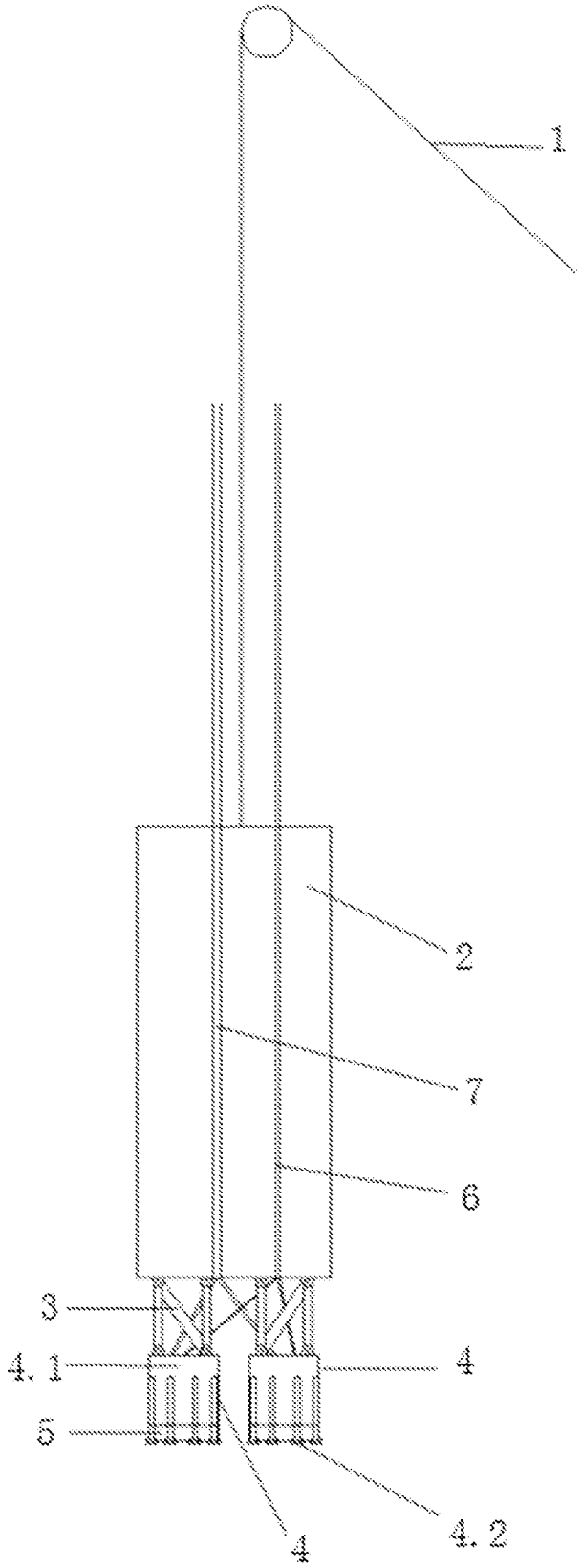
FIG. 1 is a structural schematic diagram of a diaphragm wall down-the-hole hammer trenching machine according to the present disclosure.

In the drawings, 1—crane, 2—guide frame, 3—push-pull device, 4—cluster down-the-hole hammer, 4.1—primary hammer, 4.21—first secondary hammer, 4.22—second secondary hammer, 4.2—secondary hammer, 5—gas collecting hood, 6—high-pressure medium pipe or cable, 7—slurry discharge pipe, and 8—mud channel.

Figure 2:
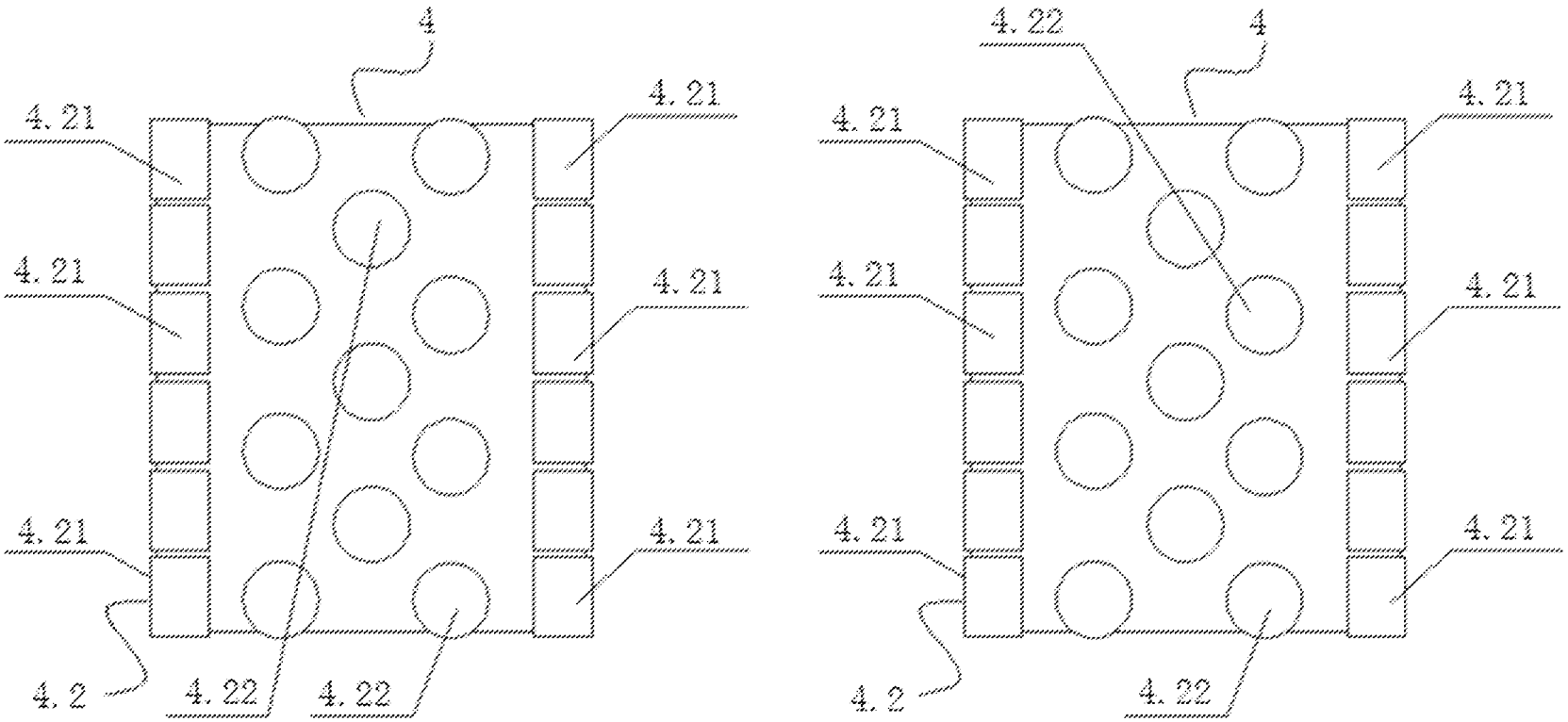
FIG. 2 is a bottom view of two cluster down-the-hole hammers in the present disclosure.

In FIG. 2, cluster down-the-hole hammers 4 are arranged at intervals, and first secondary hammers 4.21 located on the sides of two adjacent cluster down-the-hole hammers 4 are rectangular and close to each other.

DETAILED DESCRIPTION OF THE EMBODIMENTS

Embodiments of the present disclosure will be described below in detail with reference to the accompanying drawings, but they are not to be construed as limiting the present disclosure, and are provided by way of example only. At the same time, the advantages of the present disclosure will become clearer and readily understood by way of illustration.

Figure 3:
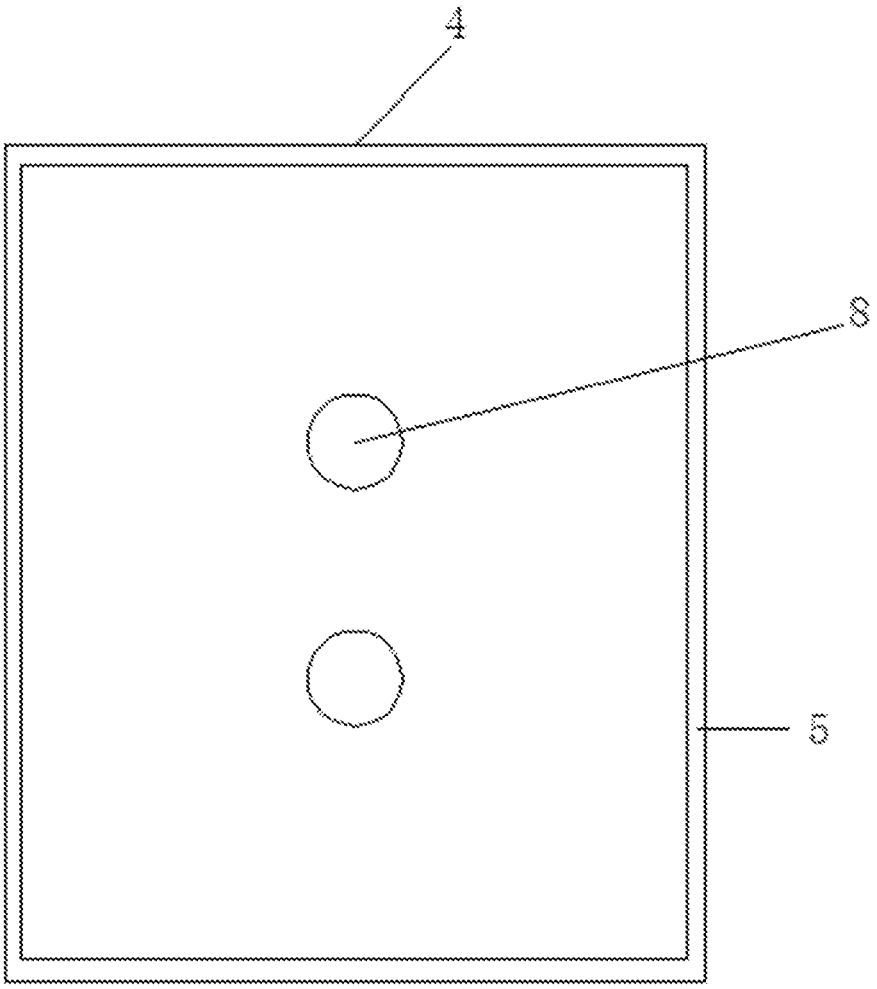
FIG. 3 is a structural schematic diagram of a cluster down-the-hole hammer, a gas collecting hood, and mud channels in the present disclosure.

With reference to the drawings, it can be seen that a diaphragm wall down-the-hole hammer trenching machine includes a crane 1, a guide frame 2, a push-pull device 3, cluster down-the-hole hammers 4, gas collecting hoods 5, a high-pressure medium pipe or cable 6, and a slurry discharge pipe 7; wherein the crane 1 suspends the guide frame 2;

the cluster down-the-hole hammers 4 are connected to the bottom of the guide frame 2 by means of the push-pull device 3;

the cluster down-the-hole hammers 4 are rectangular; the cluster down-the-hole hammers 4 are in a separate arrangement; each cluster down-the-hole hammer 4 includes a primary hammer 4.1 and secondary hammers 4.2; and the plurality of the secondary hammers 4.2 are disposed on each primary hammer 4.1, the secondary hammers 4.2 being down-hole hammers driven by a high-pressure medium or electrically (as shown in FIGS. 1 and 2); percussive drilling is performed randomly and asynchronously by the secondary hammers, which reduces an impact force on trench holes and avoids hole collapse caused by an excessive vibration force; the primary hammers are pushed and pulled by the push-pull device to be constantly and symmetrically separated or close to each other laterally to achieve full-section rock drilling of the trench holes;

the lower part of each primary hammer 4.1 is provided with one gas collecting hood 5;

the high-pressure medium pipe or cable 6 passes through the guide frame 2, and the push-pull device 3 to enter a primary hammer distribution pipeline to drive the secondary hammers 4.2 to perform percussive drilling;

mud channels 8 are formed in each primary hammer 4.1 (as shown in FIGS. 1 and 3); waste gas is discharged from the middle-upper parts of the down-the-hole hammers, and mixed with mud inside the gas collecting hoods, and under the action of mud pressure, air-lift reverse circulation is formed for slag removal, and the mixture is discharged into the slurry discharge pipe 7 through the mud channels 8 in the middles of the primary hammers 4.1, and discharged upwardly into a ground mud treatment system through the slurry discharge pipe 7; and the gas collecting hoods 5 have a sufficient height to ensure that waste gas is not discharged into trench holes outside the down-the-hole hammers 4 and the gas collecting hoods 5; and the slurry discharge pipe 7 passes through the guide frame 2 and communicates with the gas collecting hoods 5 (as shown in FIG. 1); and the slurry discharge pipe passes through the push-pull device and the guide frame to discharge the mixture into the ground mud treatment system.

Further, an exhaust port is formed in the middle-upper parts of the secondary hammers 4.2; and the exhaust port is higher than a lower opening of each gas collecting hood 5; the secondary hammers 4.2 is provided with the exhaust port at the middle-upper parts, with no vent hole at the bottoms, the exhaust port is higher than the lower opening of each gas collecting hood 5, and the gas collecting hoods 5 have a sufficient height to ensure that waste gas is not discharged into trench holes outside the down-the-hole hammers 4 to avoid hole collapse caused by gas leaking into mud in the trench holes.

Further, the secondary hammers 4.2 include first secondary hammers 4.21 and second secondary hammers 4.22;

the first secondary hammers 4.21 are located on the outer sides of the primary hammers 4.1 and on the adjacent sides of the two primary hammers 4.1; the first secondary hammers 4.21 are rectangular and close to each other; and full trench wide rock drilling is achieved; and the second secondary hammers 4.22 are circular, and a plurality of the second hammers 4.22 are in a staggered arrangement (as shown in FIG. 2).

Further, each gas collecting hood 5 is of a skirt-like structure (as shown in FIGS. 1 and 3).

Further, the cluster down-the-hole hammers 4 are movably connected with the guide frame 2 by means of the push-pull device 3 (as shown in FIG. 1); and during construction, the push-pull device 3 pushes and pulls the primary hammers 4.1 so that the primary hammers 4.1 are constantly and symmetrically separated or close to each other to achieve full-section rock drilling with the down-the-hole hammers.

The push-pull device 3 described in FIG. 1 is given by way of example only and can have other structures with the same function.

With reference to the drawings, it can be seen that a use method of the diaphragm wall down-the-hole hammer trenching machine includes the steps of, Step 1: installation;

connecting a crane 1 with a guide frame 2;

connecting two cluster down-the-hole hammers 4 to the bottom of the guide frame 2 by means of a push-pull device 3; wherein other numbers of the cluster down-the-hole hammers 4 can also be selected as desired;

allowing a high-pressure medium pipe or cable 6 to pass through the guide frame 2 and the push-pull device 3 to enter a primary hammer distribution pipeline; and allowing a slurry discharge pipe 7 to pass through the guide frame 2 and communicate with gas collecting hoods 5;

Step 2: hoisting;

suspending, by the crane 1, the guide frame 2 to a working point; and

Step 3: diaphragm wall down-the-hole hammer trenching;

driving secondary hammers 4.2 to perform percussive drilling after the high-pressure medium pipe or cable 6 enters the primary hammer distribution pipeline;

pushing and pulling primary hammers 4.1 by the push-pull device 3 so that the primary hammers 4.1 are constantly and symmetrically separated or close to each other to achieve full-section rock drilling with the down-the-hole hammers; and mixing waste gas from the down-the-hole hammers with mud in the gas collecting hoods, discharging the mixture into the slurry discharge pipe 7 through mud channels 8 in the middles of the primary hammers 4.1 under the action of mud pressure to form air-lift reverse circulation for slag removal, and discharging the mixture upwardly into a ground mud treatment system through the slurry discharge pipe 7 (as shown in FIGS. 1, 2, and 3); wherein the gas collecting hoods 5 have a sufficient height to ensure that waste gas is not discharged into trench holes outside the down-the-hole hammers 4 and the gas collecting hoods 5;

during anhydrous dry hole construction, exhaust slag blowing or air reverse circulation slag removal is conducted at the bottoms of the secondary hammers.

Furthermore, a plurality of the secondary hammers 4.2 are provided; and a plurality of the primary hammers 4.1 are provided; and percussive drilling is randomly performed by the plurality of the secondary hammers 4.2 (as shown in FIGS. 1 and 2), the secondary hammers 4.2 are down-the-hole hammers, and percussive drilling is performed randomly and asynchronously by the secondary hammers, which reduces an impact force on trench holes and avoids hole collapse caused by an excessive vibration force.

In order to be able to more clearly illustrate the advantages of the diaphragm wall down-the-hole hammer trenching machine and the use method thereof according to the present disclosure compared with the prior art, the two solutions are compared by workers, and the comparison results are shown in the following table:

| | Equipment body type | Manufacturing cost | Usage loss | Rock drilling efficiency | Trenched wall thickness and impact on engineering | Matched equipment |
|---|---|---|---|---|---|---|
| Prior art (trench milling machine) | Bulky and complex equipment | High manufacturing cost | High energy consumption during construction, fast wear of drilling tools, complex maintenance, and high cost | Low hard rock drilling efficiency | Limited maximum wall thickness, and addition of additional safety measures which increases the engineering cost | Main crane having complex functions and being specially manufactured, with a low utilization rate |
| The diaphragm wall down-the-hole impact hammer trenching machine and the use method thereof according to the present disclosure | Lightweight and simple equipment | Low manufacturing cost | Low energy consumption during construction, wear-resistant drilling tools, easy maintenance, and low cost | High hard rock drilling efficiency | Larger wall thickness, easy construction, improving the safety of diaphragm wall engineering, saving steel bar materials, and capability of reducing the engineering cost | Crane and air compressor being universal equipment, with a high utilization rate |

It can be seen from the above table that the diaphragm wall down-the-hole impact hammer trenching machine and the use method thereof according to the present disclosure has the advantages that the diaphragm wall down-the-hole hammer trenching machine is simple and lightweight in equipment, low manufacturing cost, low energy consumption during use, high drilling efficiency, easy maintenance, low cost, easy construction, and larger wall thickness compared with the prior art.

Other non-illustrated parts belong to the prior art.

What is claimed is:

1. A diaphragm wall down-the-hole hammer trenching machine, comprising a crane, a guide frame, a push-pull device, cluster down-the-hole hammers, gas collecting hoods, a high-pressure medium pipe or cable, and a slurry discharge pipe; wherein the crane suspends the guide frame;

the cluster down-the-hole hammers are connected to the bottom of the guide frame by means of the push-pull device; the cluster down-the-hole hammers are rectangular, and are in a separate arrangement; each cluster down-the-hole hammer comprises a primary hammer and secondary hammers; and the plurality of the secondary hammers are disposed on each primary hammer, the secondary hammers being down-the-hole hammers driven by a high-pressure medium or electrically;

a lower part of each primary hammer is provided with one gas collecting hood; the high-pressure medium pipe or cable passes through the guide frame to enter a primary hammer distribution pipeline to drive the secondary hammers to perform percussive drilling;

mud channels are formed in each primary hammer; and the slurry discharge pipe passes through the guide frame and communicates with the gas collecting hoods.

2. The diaphragm wall down-the-hole hammer trenching machine according to claim 1, wherein an exhaust port is formed in middle-upper parts of the secondary hammers; and the exhaust port is higher than a lower opening of each gas collecting hood.

3. The diaphragm wall down-the-hole hammer trenching machine according to claim 2, wherein the secondary hammers comprise first secondary hammers and second secondary hammers; and the first secondary hammers are located on outer sides and adjacent sides of the primary hammers; and the first secondary hammers are rectangular.

4. The diaphragm wall down-the-hole hammer trenching machine according to claim 3, wherein each gas collecting hood (5) is of a skirt-like structure.

5. The diaphragm wall down-the-hole hammer trenching machine according to claim 4, wherein the cluster down-the-hole hammers (4) are movably connected with the guide frame (2) by means of the push-pull device (3).

6. A use method of the diaphragm wall down-the-hole hammer trenching machine according to claim 1, comprising the steps of, Step 1: installation;

connecting a crane (1) with a guide frame (2);

connecting cluster down-the-hole hammers (4) to the bottom of the guide frame (2) by means of a push-pull device (3);

allowing a high-pressure medium pipe or cable (6) to pass through the guide frame (2) and the push-pull device (3) to enter a primary hammer distribution pipeline; and allowing a slurry discharge pipe (7) to pass through the guide frame (2) and communicate with gas collecting hoods (5);

Step 2: hoisting;

suspending, by the crane (1), the guide frame (2) to a working point; and Step 3: diaphragm wall down-the-hole hammer trenching driving secondary hammers (4.2) to perform percussive drilling after the high-pressure medium pipe or cable (6) enters the primary hammer distribution pipeline;

pushing and pulling primary hammers (4.1) by the push-pull device (3) so that the primary hammers (4.1) are constantly and symmetrically separated or close to each other to achieve full-section rock drilling with the down-the-hole hammers; and mixing waste gas from the down-the-hole hammers with mud in the gas collecting hoods (5), discharging the mixture into the slurry discharge pipe (7) through mud channels (8) in the middles of the primary hammers (4.1) under the action of mud pressure to form air-lift reverse circulation for slag removal, and discharging the mixture upwardly into a ground mud treatment system through the slurry discharge pipe (7).

7. The use method of the diaphragm wall down-the-hole hammer trenching machine according to claim 6, wherein a plurality of the secondary hammers (4.2) are provided; and percussive drilling is randomly performed by the plurality of the secondary hammers (4.2).

8. A use method of the diaphragm wall down-the-hole hammer trenching machine according to claim 2, comprising the steps of, Step 1: installation;

connecting a crane (1) with a guide frame (2);

connecting cluster down-the-hole hammers (4) to the bottom of the guide frame (2) by means of a push-pull device (3);

allowing a high-pressure medium pipe or cable (6) to pass through the guide frame (2) and the push-pull device (3) to enter a primary hammer distribution pipeline; and allowing a slurry discharge pipe (7) to pass through the guide frame (2) and communicate with gas collecting hoods (5);

Step 2: hoisting;

suspending, by the crane (1), the guide frame (2) to a working point; and Step 3: diaphragm wall down-the-hole hammer trenching driving secondary hammers (4.2) to perform percussive drilling after the high-pressure medium pipe or cable (6) enters the primary hammer distribution pipeline;

pushing and pulling primary hammers (4.1) by the push-pull device (3) so that the primary hammers (4.1) are constantly and symmetrically separated or close to each other to achieve full-section rock drilling with the down-the-hole hammers; and mixing waste gas from the down-the-hole hammers with mud in the gas collecting hoods (5), discharging the mixture into the slurry discharge pipe (7) through mud channels (8) in the middles of the primary hammers (4.1) under the action of mud pressure to form air-lift reverse circulation for slag removal, and discharging the mixture upwardly into a ground mud treatment system through the slurry discharge pipe (7).

9. The use method of the diaphragm wall down-the-hole hammer trenching machine according to claim 8, wherein a plurality of the secondary hammers (4.2) are provided; and percussive drilling is randomly performed by the plurality of the secondary hammers (4.2).

10. A use method of the diaphragm wall down-the-hole hammer trenching machine according to claim 3, comprising the steps of, Step 1: installation;

connecting a crane (1) with a guide frame (2);

connecting cluster down-the-hole hammers (4) to the bottom of the guide frame (2) by means of a push-pull device (3);

allowing a high-pressure medium pipe or cable (6) to pass through the guide frame (2) and the push-pull device (3) to enter a primary hammer distribution pipeline; and allowing a slurry discharge pipe (7) to pass through the guide frame (2) and communicate with gas collecting hoods (5);

Step 2: hoisting;

suspending, by the crane (1), the guide frame (2) to a working point; and Step 3: diaphragm wall down-the-hole hammer trenching driving secondary hammers (4.2) to perform percussive drilling after the high-pressure medium pipe or cable (6) enters the primary hammer distribution pipeline;

pushing and pulling primary hammers (4.1) by the push-pull device (3) so that the primary hammers (4.1) are constantly and symmetrically separated or close to each other to achieve full-section rock drilling with the down-the-hole hammers; and mixing waste gas from the down-the-hole hammers with mud in the gas collecting hoods (5), discharging the mixture into the slurry discharge pipe (7) through mud channels (8) in the middles of the primary hammers (4.1) under the action of mud pressure to form air-lift reverse circulation for slag removal, and discharging the mixture upwardly into a ground mud treatment system through the slurry discharge pipe (7).

11. The use method of the diaphragm wall down-the-hole hammer trenching machine according to claim 10, wherein a plurality of the secondary hammers (4.2) are provided; and percussive drilling is randomly performed by the plurality of the secondary hammers (4.2).

12. A use method of the diaphragm wall down-the-hole hammer trenching machine according to claim 4, comprising the steps of, Step 1: installation;

connecting a crane (1) with a guide frame (2);

connecting cluster down-the-hole hammers (4) to the bottom of the guide frame (2) by means of a push-pull device (3);

allowing a high-pressure medium pipe or cable (6) to pass through the guide frame (2) and the push-pull device (3) to enter a primary hammer distribution pipeline; and allowing a slurry discharge pipe (7) to pass through the guide frame (2) and communicate with gas collecting hoods (5);

Step 2: hoisting;

suspending, by the crane (1), the guide frame (2) to a working point; and Step 3: diaphragm wall down-the-hole hammer trenching driving secondary hammers (4.2) to perform percussive drilling after the high-pressure medium pipe or cable (6) enters the primary hammer distribution pipeline;

pushing and pulling primary hammers (4.1) by the push-pull device (3) so that the primary hammers (4.1) are constantly and symmetrically separated or close to each other to achieve full-section rock drilling with the down-the-hole hammers; and mixing waste gas from the down-the-hole hammers with mud in the gas collecting hoods (5), discharging the mixture into the slurry discharge pipe (7) through mud channels (8) in the middles of the primary hammers (4.1) under the action of mud pressure to form air-lift reverse circulation for slag removal, and discharging the mixture upwardly into a ground mud treatment system through the slurry discharge pipe (7).

13. The use method of the diaphragm wall down-the-hole hammer trenching machine according to claim 12, wherein a plurality of the secondary hammers (4.2) are provided; and percussive drilling is randomly performed by the plurality of the secondary hammers (4.2).

14. A use method of the diaphragm wall down-the-hole hammer trenching machine according to claim 5, comprising the steps of, Step 1: installation;

connecting a crane (1) with a guide frame (2);

connecting cluster down-the-hole hammers (4) to the bottom of the guide frame (2) by means of a push-pull device (3);

allowing a high-pressure medium pipe or cable (6) to pass through the guide frame (2) and the push-pull device (3) to enter a primary hammer distribution pipeline; and allowing a slurry discharge pipe (7) to pass through the guide frame (2) and communicate with gas collecting hoods (5);

Step 2: hoisting;

suspending, by the crane (1), the guide frame (2) to a working point; and Step 3: diaphragm wall down-the-hole hammer trenching driving secondary hammers (4.2) to perform percussive drilling after the high-pressure medium pipe or cable (6) enters the primary hammer distribution pipeline;

pushing and pulling primary hammers (4.1) by the push-pull device (3) so that the primary hammers (4.1) are constantly and symmetrically separated or close to each other to achieve full-section rock drilling with the down-the-hole hammers; and mixing waste gas from the down-the-hole hammers with mud in the gas collecting hoods (5), discharging the mixture into the slurry discharge pipe (7) through mud channels (8) in the middles of the primary hammers (4.1) under the action of mud pressure to form air-lift reverse circulation for slag removal, and discharging the mixture upwardly into a ground mud treatment system through the slurry discharge pipe (7).

15. The use method of the diaphragm wall down-the-hole hammer trenching machine according to claim 14, wherein a plurality of the secondary hammers (4.2) are provided; and percussive drilling is randomly performed by the plurality of the secondary hammers (4.2).

* * * * *